United States Patent [19]

Nambudiry

[11] Patent Number: 4,812,252

[45] Date of Patent: Mar. 14, 1989

[54] DETERGENT COMPOSITION

[75] Inventor: Mayara E. N. Nambudiry, Maharashtra, India

[73] Assignee: Lever Brothers Company, New York, N.Y.

[21] Appl. No.: 189,577

[22] Filed: May 3, 1988

[30] Foreign Application Priority Data

Mar. 20, 1987 [IN] India ..... 91/BOM/87
May 6, 1987 [GB] United Kingdom ..... 8710689

[51] Int. Cl.[4] ..... C11D 9/00; C11D 9/26

[52] U.S. Cl. ..... 252/108; 252/132; 252/368; 252/DIG. 16; 562/579; 562/588

[58] Field of Search ..... 252/108, 132, 368, DIG. 16; 562/579, 588

[56] References Cited

FOREIGN PATENT DOCUMENTS 2400420 7/1974 Fed. Rep. of Germany .
62-246540 10/1987 Japan .
1281895 7/1972 United Kingdom .
1287895 9/1972 United Kingdom .
1295275 11/1972 United Kingdom .
1314604 4/1973 United Kingdom .

OTHER PUBLICATIONS

Chemical Abstract No. 92525p, vol. 66 (1967).

*Primary Examiner*—Paul Lieberman
*Assistant Examiner*—Christine A. Skane
*Attorney, Agent, or Firm*—Gerard J. McGowan, Jr.; James J. Farrell

[57] ABSTRACT

A soap-based detergent composition comprises water soluble salts of monocarboxylic acids having 8 to 22 carbon atoms, preferably consisting of a major proportion of salts of monocarboxylic acids having 16 or more carbon atoms and optionally a minor proportion of salts of monocarboxylic acids having 14 or less carbon atoms, characterized in that the composition contains a water soluble organic salt of formula $$R_1—O—(CR_2R_3)_n—CO_2M$$

wherein $R_1$ is alkyl, alkenyl or alkynyl, $R_2$ with respect to each occurrence are the same or different and are selected from H, alkyl and alkenyl groups, $R_3$ with respect to each occurrence are the same or different and are selected from H, alkyl and alkenyl groups, n is 2,3 or 4, and M is a cation providing water soluble properties.

Inclusion of such organic salts e.g. 3-alkoxy propionate can replace in whole or in part in a predominantly soap composition soaps derived from fatty acids having 14 or less carbon atoms.

9 Claims, No Drawings

DETERGENT COMPOSITION

The present invention relates to a detergent composition intended primarily for personal washing.

Conventionally a detergent composition intended for personal washing consists of a mixture of soaps i.e. water soluble salts of long chain ($C_8$ to $C_{22}$) monocarboxylic acids. The mixture usually comprises a major proportion of salts of longer chain i.e. C16 and above monocarboxylic acids and a minor proportion of salts of shorter chain, i.e. $C_{14}$ and below monocarboxylic acids. Usually the longer chain soaps will form at least 60 wt % of the soap content and the shorter chain soaps up to 40 wt %. Typically the longer chain soaps comprise at least 70 wt % and the shorter chain soaps up to 30 wt % of the composition. Frequently a soap bar intended for personal washing will have a soap composition comprising about 80 wt % of $C_{16}$ and above soaps and 20 wt % of $C_{14}$ and below soaps.

The usual source for the feedstocks for the fatty acids from which the soaps are prepared are natural triglyceride fat and oils from vegetable, animal and marine sources. Alternatively however synthetic feedstocks can be employed such as those obtained by the oxidation of paraffins. The natural sources are however preferred. They tend moreover to provide triglycerides which yield fatty acids predominantly having $C_{16}$ and above chain lengths or $C_{14}$ and below chain lengths. Examples of oils yielding the longer chain fatty acids are tallow, palm oil, soyabean oil, castor oil, rice bran oil and fish oil. Appropriate processing e.g. hardening and dehydroxylation may be necessary. Examples of triglycerides yielding the shorter chain fatty acids are coconut oil, palmkernel oil and babassau oil. The proportions of and the particular ingredients employed in soapmaking can be selected having regard to local conditions of supply and price. In practice the price commanded by the shorter chain triglycerides is consistently above that of the longer chain triglycerides. The shorter chain soaps have however been considered essential in a soap composition as they are acknowledged to provide the lather generated during use.

Attempts have been made in the past to provide materials which can be employed in place of the for example coconut derived soaps. Examples of the use of an alternative material are found in UK Nos. 1281895, 1295275, 1314604 and 1287895.

According to the present invention there is provided a soap-based detergent composition comprising water soluble salts of monocarboxylic acids having 8 to 22 carbon atoms, preferably consisting of a major proportion of salts of monocarboxylic acids having 16 or more carbon atoms and optionally a minor proportion of salts of monocarboxylic acids having 14 or less carbon atoms, characterised in that the composition contains a water soluble organic salt of formula $$R_1—O—(CR_2R_3)_n—CO_2M$$

wherein $R_1$ is alkyl, alkenyl or alkynyl, $R_2$ with respect to each occurrence are the same or different and are selected from H, alkyl and alkenyl groups, $R_3$ with respect to each occurrence are the same or different and are selected from H, alkyl and alkenyl groups, n is 2,3 or 4, and M is a cation providing water soluble properties.

The applicants have found that inclusion of such an organic salt which is the salt of an alkoxy carboxylic acid can replace in whole or in part in a predominantly soap composition the soaps derived from fatty acids having 14 or less carbon atoms.

$R_1$ can be linear or branched. Preferably $R_1$ has from 4 to 12 carbon atoms, more preferably from 8 to 10 carbon atoms. Any branching present is suitably methyl or ethyl. Preferred examples of $R_1$ include 2-ethyl hexyl, iso-nonyl, iso-octyl and n-octyl groups.

$R_2$ and $R_3$ are with respect to each occurrence preferably selected from among H, methyl and ethyl groups. Preferably n is 2 and $R_2$ and $R_3$ are with respect to each occurrence H, so that the salt is a salt of a 3-alkoxy propionic acid.

Suitable examples of M include alkali metal ions, alkaline earth metal ions and ammonium ions, the ammonium optionally being substituted with at least one $C_{1\ to\ 4}$ alkyl or $C_{1\ to\ 4}$ alkanol groups. Preferably M will be alkali metal ions i.e. potassium, more preferably sodium.

In terms of the lather properties of the present composition the applicants have found that on a weight for weight basis less of the present organic salt is needed than coconut oil soap in order to achieve a similar result in a for example tallow or rice bran oil based soap. Suitably the present detergent compositions contain from about 1 wt % to about 20 wt % with respect to the total composition of the water soluble organic salt $R_1—O—(CR_2R_3)_n—CO_2M$.

The total amount present in the present composition of salts of monocarboxylic acids is preferably at least 30 wt % and at most 90 wt %, more preferably at least 40 wt % and at most 90 wt %. The remainder of the composition comprises moisture, usually of the order of 10 to 15 wt %, and optional additional ingredients. Such ingredients include conventional additives such as pigments, stabilisers, fluorescers, germicides, free fatty acids, perfumes, non-soap detergents fillers and structurants. Examples of non-soap detergents which may be included are alkane sulphonates, alcohol sulphates, alkyl benzene sulphonates, alkyl sulphates, acyl isethionates, olefin sulphonates and ethoxylated alcohols. Examples of fillers and structurants which may be included are kaolin and starch, cellulose and derivatives thereof.

The water soluble salts of monocarboxylic acids having 16 or more carbon atoms are derived preferably from triglyceride oils selected from the group comprising tallow, palm oil, soyabean oil, castor oil, rice bran oil, fish oil and mixtures thereof. As appropriate hydrogenated derivatives, dehydroxylated derivatives or fractions thereof may be employed. Suitably the salts present of monocarboxylic acids comprise from about 60 wt % to about 100 wt % of salts of acids having 16 or more carbon atoms, more suitably from about 70 wt % to about 100 wt %.

The salts present of monocarboxylic acids can further comprise salts of acids containing 8 to 14 carbon atoms. Such soaps will usually be obtained from high lauric oils such as coconut oil, palm kernel oil, babassu oil, pilu fat and mixtures thereof. Hydrogenated derivatives and fractions thereof may be used as appropriate. Suitably salts of monocarboxylic acids containing 8 to 14 carbon atoms comprise at most 40 wt %, more suitably at most 30 wt %, of the total salts present of monocarboxylic acids. The salts of monocarboxylic acids containing 8 to 14 carbon atoms can however comprise at most 5 wt %, or even 0 wt %, of the total salts of monocarboxylic acids present. A preferred range is from about 1 to about 20 wt % if it is desired to include such shorter chain soaps.

The cation of the water soluble salts present of monocarboxylic acids will be one imparting water soluble properties. Conventional examples are alkali metal ions and ammonium and substituted ammonium ions. Preferred are sodium and potassium ions, especially sodium.

The organic salt $R_1—O(CR_2R_3)_n—CO_2M$ can be prepared by a number of routes. The preparative pathways available include:

(i) Condensation of an alkanol with acrylonitrile and/or methacrylonitrile to derive 3-alkoxy propionitrile and/or further substituted propionitrile which is subsequently hydrolysed to the corresponding acid from which the salt is prepared.

(ii) Condensation of an alkanol with an alkyl acrylate to yield a 3-alkoxy propionate ester which on hydrolysis gives the salt.

(iii) Condensation of an alkanol with acrylic acid to yield 3-alkoxy propionate ester which on hydrolysis gives the salt.

(iv) Reaction of metal alkoxide with 3-chloro propionic acid to yield directly the equivalent metal salt of 3-alkoxy propionic acid.

The present composition is preferaly in solid form, such as a bar, stick, sheet granules, powder or flakes. Bar form is preferred. If desired however the present composition can be in liquid form.

Conventional soap making techniques are suitably employed for preparing the present composition. The alkoxy salts can be prepared separately and added at any convenient point to the neutralised soap mix. Alternatively the equivalent alkoxy acid can be prepared and admixed with the fatty acids or triglycerides comprising the soap feedstock materials and the resulting mixture appropriately treated with alkali.

Embodiments of the present invention will now be described by way of example only with reference to the following examples.

Three different 3-alkoxy propionates were employed in the Examples. They were sodium salts of respectively 3-(2 ethyl) hexyloxy propionic acid, 3-iso octyloxy propionic acid and 3-isononyloxy propionic acid. In each case the sodium propionate was prepared from the appropriate propionitrile. The resulting sodium propionate can be used in a crude form, or purified if desired by appropriate techniques such as solvent treatment.

The detailed preparation of sodium 3-(2 ethyl) hexyloxy propionate was as follows.

Potassium hydroxide (5 g) was dissolved in 2-ethyl hexanol (1.3 kg, 10 mol) with mechanical stirring and warming. Acrylonitrile (538 g, 10.1 moles) was added during 2 hours at room temperature. The reaction mixture was stirred at this temperature for 2 hours. Thin layer chromatography (4:1 hexane:ether) indicated almost complete disappearance of the alcohol. The cooled reaction mixture was neutralised with hydrochloric acid, washed neutral and the nitrile (1.74 kg) was used as such, without distillation, for further conversion.

A mixture of the nitrile (1.74 kg, 9.4 mole) and 35% hydrochloric acid (1.8 l, 19 moles) was stirred and heated at 80° C. for 1 hour and then at 100° to 110° C. for 5 hours. Thin layer chromatography (4:1 hexane:ether) indicated practically complete disappearance of the nitrile. Cooled, ammonium chloride (330 g) that separated out was filtered off and the organic phase washed free of mineral acid to get the crude acid (1.7 kg) which on fractionation at 1–1.5 mm Hg gave impure acid (1.397 kg; acid value 208 corresponding to approx. 80% acid content; boiling point 140°–142° C. at 1–1.5 mm Hg). The acid was neutralised with 20% sodium hydroxide solution (1180 ml) at 15° to 20° C. and after a preliminary drying at 100° C. for 3 hours the sodium salt was precipitated out by adding acetone.

The dried sodium 3-(2 ethyl) hexyloxy propionate (1.1 kg) had 2.6% retained moisture (at 110° C.), an acid value of 0.68 and an active acid content (an estimate of the total fatty matter present) of 87.75 wt %.

Sodium 3-isodecyloxy propionate was prepared using the procedure described for sodium 3-(2 ethyl) hexyloxy propionate and starting from 0.6 g sodium, 800 g isodecanol (5 mole) and 280 g acrylonitrile (5.25 mole). The dried sodium propionate salt had 3.8 wt % retained moisture (at 110° C.), an acid value of 0.68 and an active acid content (an indication of the total fatty matter present) of 87.53 wt %.

Other preparative routes are available and can be used with or without acetone precipitation of the salt.

In the following examples the latherability of various compositions and active components making up the compositions is assessed. The following standard test was used in each case.

Lather from a material being tested was generated using a domestic kitchen mixer. 10 g (unless otherwise stated) of the material in a particulate form were placed with 100 ml water of 24° FH in the mixer. The mixer was run for 20 seconds, stopped for 20 seconds and then run for 20 seconds. The lather generated was then poured into a measuring cylinder and the volume recorded initially and after 5 minutes or only after 5 minutes in order to obtain an estimate of the durable lather.

EXAMPLES 1 to 3

Each of the above three 3-alkoxy propionates was incorporated in two differing soap compositions A and B with the exception of Ex. 2 which employed soap base B only. The sodium 3-alkoxy propionates were each incorporated in each soap base at levels of 5 and 10 wt % respectively. For comparison coconut oil soap was added to samples of soap base A and sodium laurate was added to samples of each soap at the same levels.

Soap base A was a soap base made solely from distilled fatty acids derived from hardened rice bran oil. Soap base B was a commercial toilet soap containing 4 to 6 wt % coconut oil soaps. The fatty acid composition of each soap base was as follows:

| | Fatty acid composition | | | | | | | | |
|---|---|---|---|---|---|---|---|---|---|
| | C8 | C10 | C12 | C14 | C16 | C18 | C18:1 | C18:2 | C20 |
| Soap base A | — | — | 0.6 | 0.9 | 21.5 | 2.8 | 45.0 | 28.3 | 0.9 |
| Soap base B | 0.8 | 0.2 | 2.0 | 0.7 | 19.6 | 30.3 | 37.4 | 7.3 | 1.3 |

Lather testing was performed on each composition following the above methodology and the lather volume recorded after 5 minutes. For comparison the same lather test was carried out on the separate components making up each sample viz. each alkoxy material, each soap base, the added comparative coconut oil soap and the added sodium laurate at concentration levels corresponding to those present in each example.

The results are given in Table I below. As can be seen from Table I the lather volumes of the compositions embodying the present invention are greater than the sum of the lather volumes of the components taken separately.

TABLE I

| Example | Material added to A or B | Level of addition in A or B | Lather volume (ml) | Concentration of material in water (g/100 ml) | Lather volume (ml) | Concentration of soap base in water (g/100 ml) | Lather volume (ml) |
|---|---|---|---|---|---|---|---|
| 1. | 3-(2 ethyl) hexyloxy propionate | 5 wt % in A | 340 | 0.5 | 0 | 9.5 | 183 |
| | | 5 wt % in B | 290 | 0.5 | 0 | 9.5 | 145 |
| | | 10 wt % in A | 540 | 1.0 | 0 | 9.0 | 183 |
| | | 10 wt % in B | 515 | 1.0 | 0 | 9.0 | 145 |
| 2. | 3-iso octyl oxypropionate | 5 wt % in B | 285 | 0.5 | 0 | 9.5 | 145 |
| | | 10 wt % in B | 425 | 1.0 | 0 | 9.0 | 145 |
| 3. | 3-isononyloxy propionate | 5 wt % in A | 300 | 0.5 | 5 | 9.5 | 183 |
| | | 5 wt % in B | 300 | 0.5 | 5 | 9.5 | 145 |
| | | 10 wt % in A | 480 | 1.0 | 24 | 9.0 | 183 |
| | | 10 wt % in B | 490 | 1.0 | 24 | 9.0 | 145 |
| | Coconut soap | 5 wt % in A | 235 | 0.5 | 235 | 9.5 | 183 |
| | | 10 wt % in A | 293 | 1.0 | 384 | 9.0 | 183 |
| | Sodium laurate | 5 wt % in A | 265 | 0.5 | 240 | 9.5 | 183 |
| | | 5 wt % in B | 282 | 0.5 | 240 | 9.5 | 145 |
| | | 10 wt % in A | 300 | 1.0 | 660 | 9.0 | 183 |
| | | 10 wt % in B | 332 | 1.0 | 660 | 9.0 | 145 |

EXAMPLE 4

A sample of sodium 3-(2 ethyl) hexyloxy propionate prepared as above was incorporated at a level of 10 wt % with respect to the total composition in a soap made from partially hardened rice bran oil. As controls using the same source of rice bran oil soap compositions were prepared containing with respect to the total composition respectively 10 wt %, 20 wt %, 30 wt %, 40 wt % and 50 wt % coconut soap. For each composition so prepared lather assessment tests were performed. The results are given in Table II below which includes the equivalent lather test performed on the rice bran oil soap per se.

TABLE II

| Example No. | Material added | Level of addition (wt %) | Lather (vol. ml) Initial | Lather (vol. ml) After 5 mins |
|---|---|---|---|---|
| 4. | 3-(2 ethyl) hexyloxy propionate | 10 | 580 | 540 |
| | Coconut soap | 10 | 345 | 293 |
| | " | 20 | 390 | 345 |
| | " | 30 | 490 | 450 |
| | " | 40 | 570 | 525 |
| | " | 50 | 670 | 650 |
| Control | Rice bran soap | — | 260 | 183 |

As can be seen from Table II the detergent composition containing 10 wt % sodium 3-(2 ethyl) hexyloxy propionate has latherability properties similar to soap compositions containing at least 40 wt % coconut oil soap.

I claim:

1. A soap-based detergent composition comprising water soluble salts of monocarboxylic acids having 8 to 22 carbon atoms characterised in that the composition contains from about 1 wt % to about 20 wt % of a water soluble organic salt of formula $$R_1—O—(CR_2R_3)_n—CO_2M$$

wherein $R_1$ is alkyl, alkenyl or alkynyl having 4 to 12 carbon atoms, $R_2$ with respect to each occurrence are the same or different and are selected from H, alkyl and alkenyl groups, $R_3$ with respect to each occurrence are the same or different and are selected from H, alkyl and alkenyl groups, n is 2,3 or 4, and M is a cation providing water soluble properties.

2. Composition according to claim 1 wherein n is 2 and $R_2$ and $R_3$ are H.

3. Composition according to claim 1 wherein the said salts of water soluble monocarboxylic acids comprise a major proportion of water soluble salts of monocarboxylic acids having 16 or more carbon atoms and optionally a minor proportion of water soluble salts of monocarboxylic acids having 14 or less carbon atoms.

4. Composition according to claim 3 containing from about 60 wt % to about 100 wt %, with respect to the total amount present of water soluble salts of monocarboxylic acids, water soluble salts of monocarboxylic acids having 16 or more carbon atoms.

5. Composition according to claim 3 containing from about 1 to about 20 wt % of water soluble salts of monocarboxylic acids having 14 or less carbon atoms, with respect so the total amount present of water soluble salts of monocarboxylic acids.

6. Composition according to claim 3 wherein the water soluble salts of monocarboxylic acids having 16 or more carbon atoms are derived from triglyceride oils selected from the group comprising tallow, palm oil, soyabean oil, castor oil, rice bran oil, fish oil, hydrogenated derivatives thereof, dehydroxylated derivatives thereof, fractions thereof and mixtures thereof.

7. Composition according to claim 3 wherein the water soluble salts of monocarboxylic acids having 14 or less carbon atoms are derived from triglyceride oils selected from the group comprising coconut oil, palm kernel oil, babassu oil, pilu fat, hydrogenated derivatives thereof, fractions thereof and mixtures thereof.

8. Detergent composition according to claim 1 in solid form.

9. Detergent composition according to claim 8 in the form of a bar.

* * * * *